US005077958A

United States Patent [19]

Peppard et al.

[11] Patent Number: 5,077,958

[45] Date of Patent: Jan. 7, 1992

[54] PACKAGING MACHINE & METHOD

[75] Inventors: James P. Peppard, Newbury; Rick S. Wehrmann, Hudson; Anthony H. Gates, Atwood; Bernard Lerner, Aurora, all of Ohio

[73] Assignee: Automated Packaging Systems, Inc., Twinsburg, Ohio

[21] Appl. No.: 395,957

[22] Filed: Aug. 18, 1989

[51] Int. Cl.[5] ..... B65B 7/06; B65B 39/10; B65B 43/54; B65B 51/14

[52] U.S. Cl. ..... 53/570; 53/284.7; 53/329.3; 53/375.4; 53/373.6; 53/373.7

[58] Field of Search ..... 53/570, 571, 284.7, 53/329.3, 373.6, 373.7, 374.5, 374.6, 375.4, 261, 53

[56] References Cited

U.S. PATENT DOCUMENTS

| | | | |
|---|---|---|---|
| 2,507,905 | 5/1950 | Hughes | 53/373.6 X |
| 2,721,018 | 10/1955 | Heavin | 53/284.7 |
| 2,732,988 | 1/1956 | Feinstein | 53/373.6 X |
| 3,254,828 | 6/1966 | Lerner . | |
| 3,579,957 | 5/1971 | Mills, Jr. et al. | 53/261 X |
| 3,750,721 | 8/1973 | Hudson | 53/570 X |
| 3,945,173 | 3/1976 | Buzzi | 53/284.7 X |
| 3,948,019 | 4/1976 | Döring et al. | 53/570 X |
| 3,949,536 | 4/1976 | Chevalier . | |
| 3,956,866 | 5/1976 | Lattur . | |
| 3,965,653 | 6/1976 | Lerner . | |
| 3,982,376 | 9/1976 | Ikeda | 53/53 |
| 4,033,093 | 7/1977 | Mencacci | 53/571 X |
| 4,124,966 | 11/1978 | Wilson | 53/284.7 X |
| 4,174,599 | 11/1979 | Callet et al. | 53/570 X |
| 4,179,867 | 12/1979 | Bodolay . | |
| 4,201,029 | 5/1980 | Lerner et al. . | |
| 4,214,417 | 7/1980 | Lieder | 53/375.4 X |
| 4,330,288 | 5/1982 | Russell et al. . | |
| 4,348,852 | 9/1982 | Clancy | 53/570 X |
| 4,353,198 | 10/1982 | Koppe | 53/570 |
| 4,392,056 | 7/1983 | Weyandt . | |
| 4,467,207 | 8/1984 | Lerner et al. . | |
| 4,510,736 | 4/1985 | Müller | 53/284.7 X |
| 4,580,393 | 4/1986 | Furukawa | 53/571 X |
| 4,651,506 | 3/1987 | Lerner et al. . | |
| 4,680,205 | 7/1987 | Lerner et al. . | |
| 4,969,310 | 11/1990 | Lerner et al. . | |

*Primary Examiner*—Horace M. Culver
*Attorney, Agent, or Firm*—Watts, Hoffmann, Fisher & Heinke

[57] ABSTRACT

A packaging machine and method of packaging utilizing chains of interconnected preopened bags which are fed sequentially and one at a time to a load station. Bag tops are clamped against spreading horns by sensor equipped clamps which cause disablement of a bag filling mechanism unless a bag is properly located at the load station. A bag spreading and transfer mechanism spreads a loaded bag and transfers it to a bag closure station for sealing. The mechanism includes bag-supporting structures for supporting the bag during loading transfer and sealing and for expelling a completed package from the machine.

14 Claims, 9 Drawing Sheets

PACKAGING MACHINE & METHOD

DISCLOSURE OF THE INVENTION

This invention relates to packaging and more particularly to a novel improved method and apparatus of packaging liquid and pulverulent materials in bags.

BACKGROUND OF THE INVENTION

The packaging of candy and other food products in bags presents some problems. First among these is that the equipment for doing so must be constructed in such a way that it is readily sanitizable and otherwise meets standards of cleanliness such as, in the United States, regulations of the Federal Government.

Powdery food products as well as other pulverulent materials present special problems. The "dumping" of such a product into a bag results in airborne dust particles which tend to adhere to bag surfaces and inhibit proper formation of a heat seal to close a loaded bag and complete a package. Similarly if liquids are being packaged and a surface to be sealed is wet or if, during the loading process, other substances become adhered to surfaces to be sealed, proper sealing is inhibited.

The use of chains of pre-opened bags to form packages is now well known. Such chains of bags are disclosed and claimed in U.S. Pat. No. 3,254,828 entitled FLEXIBLE CONTAINER STRIPS (The Autobag Patent). A commercial version of a machine described and claimed in U.S. Pat. No. 3,965,653 entitled PACKAGING APPARATUS, and in other patents deriving from the applications that resulted in this patent, (the H-100 Patents) has been sold commercially by Automated Packaging Systems, Inc. under the designation H-100. While the H-100 machine has been very successful it is a machine in which bag separation and sealing of a loaded bag are completed before a succeeding bag is positioned in an opened condition at a load station and loaded. This sequential operation is a limiting factor on the speed at which packaging operations are performed.

Another machine which has been successfully used commercially, for bagging chickens in operations where the bags are not sealed is sold by Automated Packaging as a part of its PHS-2000 system and is the commercial version of the machine described and claimed in U.S. Pat. No. 4,651,506 entitled PACKAGING APPARATUS AND METHOD (The Chicken Bagger Patent).

A limitation on the use of chains of interconnected pre-opened bags has been when heavy or bulky products are packaged it becomes difficult to properly register the face of the bag with the back of the bag to effect a high quality, neat appearing seal. While special techniques and equipment such as that described in U.S. Pat. No. 3,956,866 entitled PACKAGING METHOD AND APPARATUS have been developed to assist in the proper packaging of relatively bulky and/or heavy materials, the use of pre-opened bags on a roll has none the less been limited to moderate size bags. The essentially bulk packaging of such products as rock candy and granular dog food have at most been packaged with chains of pre-opened bags in very limited quantities if at all.

While attempts have been made to produce chains of interconnected pre-opened bags suitable for use in packaging pulverulent products such as that described and claimed in U.S. Pat. No. 3,948,015 entitled PACKAGING SYSTEM none have enjoyed success. One problem with the system described in this referenced patent was the bag opening was of limited size inhibiting high volume efficient production packaging of pulverulent materials.

In the packaging of some materials it is desirable to charge gas into the package or to evacuate the package or both. In the past little if any commercial packaging has been performed with pre-opened interconnected bags produced packages in which the contents are either gas charged or evacuated.

SUMMARY OF THE INVENTION

In the currently preferred embodiment of a system utilizing the present invention, a machine of the type described and claimed in the Chicken Bagger Patent is provided. Where products such as small pieces of hard or relatively hard candy or dog food of a granular type are to be packaged, a dispenser is mounted above the bag machine for discharging premeasured quantities of material to be packaged sequentially and one at a time. A suitable dispenser for this purpose is that sold commercially under the designation Model F-108 Automatic Scale by TRIDYNE PROCESS SYSTEMS.

A bag shuttle mechanism is provided to transport bags from a load station to a sealing station and thence discharge loaded and sealed packages. With a system made in accordance to this invention bag spreaders in the configuration of the horns of the Chicken Bagger Patent are provided, but in a modified form. Each of the horns has a finger receiving recess formed in it.

A bag stretcher is provided. The bag stretcher includes spaced mirror image mechanisms. Each mechanism has a finger which is moved into the finger engaging recess of an associated horn. Once the fingers are positioned in the recesses the bag is clamped and then the fingers are spread to stretch the bag. As the filling process is completed the horns are withdrawn and concurrently the fingers are spread to stretch the bag until top portions of the front and back of the bag are juxtaposed. Once these portions are juxtaposed a gas may be charged into the bag and/or evacuation may be readily achieved.

The bag stretcher is mounted on a carriage. The carriage in turn is mounted on guides which permit the carriage and supported stretcher to reciprocate from a position where a loaded bag is grasped and spread to a position where a loaded bag has been moved into a bag closure station. Concurrent with the movement of the loaded bag from the loading station to the closure station a subsequent bag is fed into the loading station and loading of the subsequent bag commences.

In the preferred embodiment of the mechanism a heat sealer is provided at the closure station. The heat sealer is clamped on the juxtaposed upper portions of a loaded bag positioned in the closure station. Once the sealer has closed on the loaded bag the fingers are withdrawn from the bag and the carriage reciprocates back to its load station position.

A lower bag support is provided in the form of a series of spaced bars. A carriage base structure is provided in the form of a series of generally Z shaped bars each interposed between a different adjacent pair of the support bars. Each Z shaped bar is pivotally connected to the carriage at a location near the end of one head of the Z. When a loaded bag is to be transported from the load to the closure station, the base structure bars are pivoted upwardly until each has a leg of its Z configuration parallel to and slightly above the lower support bars to lift the loaded bag and support it as it is shuttled from the load to the closure station. Concurrently the leg of each Z remote from the pivoted leg projects generally vertically upwardly.

After the carriage base structure has pivoted such that the Z shaped bars are supporting the loaded but unsealed bag the carriage moves to transport the loaded bag to the closure station. By the time the carriage movement commences, the sealer has completed sealing the previously loaded bag and moved to an open position. As the carriage reciprocates the upwardly projecting remote legs of the Z bars will engage the completed package after its release from the sealer, if it is still present on the bag support, and push it off the bag support into whatever mechanism is provided to receive completed packages.

An intermediate bag support structure is also provided. The intermediate bag support structure includes mirror image reciprocal mechanisms. Each reciprocal mechanism has U shaped elements adapted to support a bag at the load station intermediate the bag spreading horns and the lower bag support. The mechanism also has an L shaped element which is spaced downstream from the U shaped elements and adapted to support a loaded bag positioned in the closure station.

The intermediate support mechanism is mounted on the carriage. As the carriage shifts to move a loaded and unsealed bag from the load to the closure station the U shaped elements move with the carriage and support the loaded bag. Concurrently the L shaped elements function to expel the completed package from the closure station.

After a loaded but unsealed bag has been transported to the closure station and the heat sealer has closed upon it the intermediate support mechanisms are moved outwardly relative to one another concurrently with the withdrawal of the bag stretching fingers from the loaded bag. The intermediate support remains in a retracted position as do the bag stretching fingers as the carriage reciprocates back to its load station position. Thereupon the intermediate bag support mechanisms move towards one another to provide support to the bag now being loaded at the load station and the bag being sealed at the closure station.

One of the outstanding features of the invention is a sensor and a bagger disabler. When the horns of the Chicken Bagger Patent spread a bag a pair of gripper pads engage the bag to clamp it against the respective horns. With the present invention, the bag gripper is a tubular element. An axially mounted, spring biased sensor is positioned within the bag gripper to engage the bag. If no bag is present, the sensor will complete a circuit with the engaged horn and transmit a signal to a bag disabling means to prevent discharge of products to be packaged by the dispenser. If a bag is present and positioned on the horns, the insulating properties of the bag prevents the completion of the circuit and discharge is enabled.

In the event of a disabling signal the bag feed mechanism and horns will cycle again. Thus, if there has been a malfunction of the bag feeding mechanism and followed by a proper bag feed the machine will proceed. In the preferred embodiment the machine makes a predetermined attempt at positioning a bag in the load station an if it fails in all three attempts the machine will shut down.

Accordingly, the objects of this invention are to provide a novel and improved packaging machine and a method of packaging.

DESCRIPTION OF PREFERRED EMBODIMENT

Figure 1:
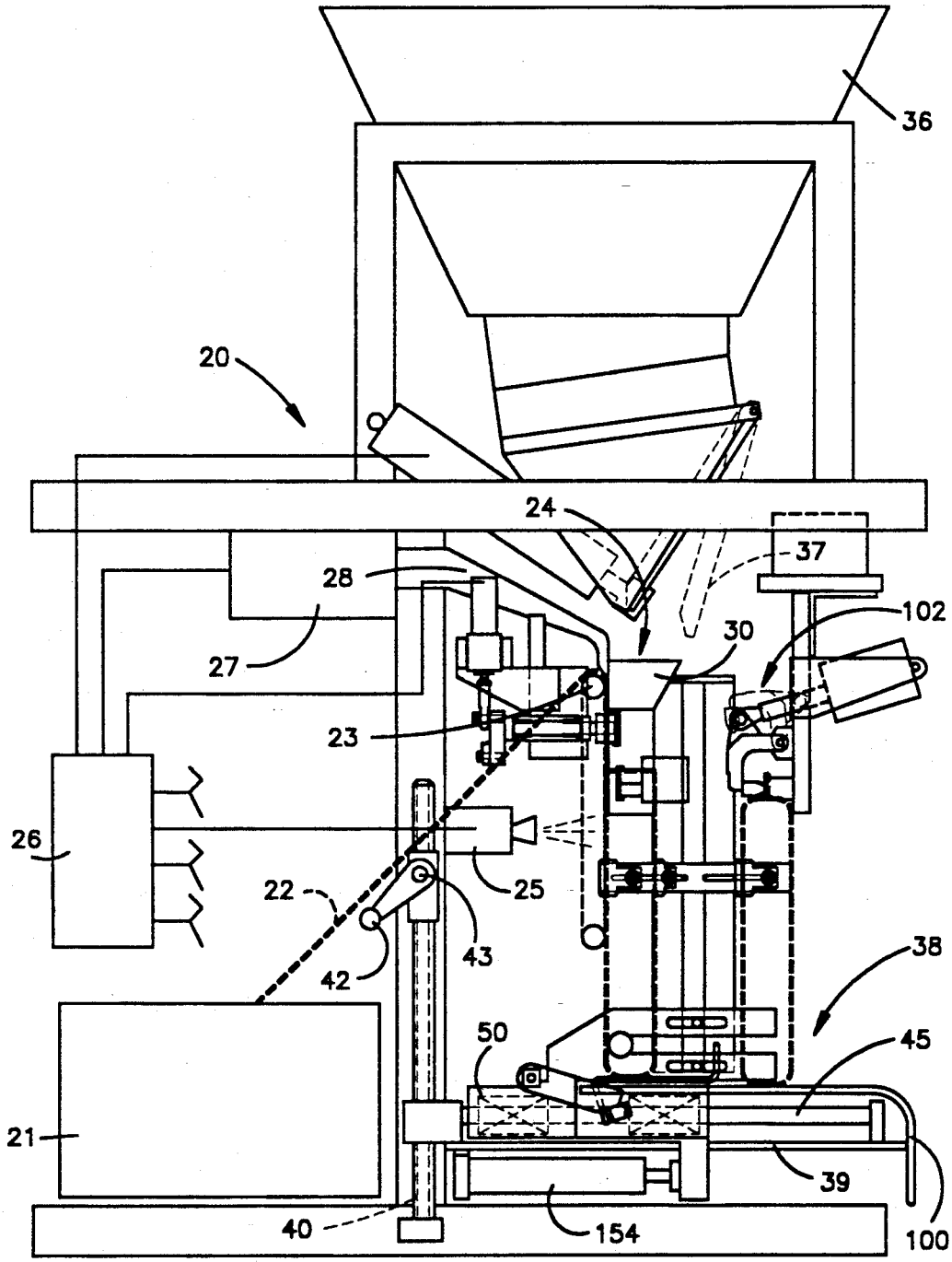
FIG. 1 is a schematic view of a packaging system of this invention shown in side elevation.

Referring now to the drawings and to FIG. 1 in particular, a bagging machine made in substantial conformance with teachings of the Chicken Bagger Patent is shown schematically at 20. A bag supply of the type described and claimed in U.S. Pat. No. 4,201,029 entitled METHOD AND APPARATUS FOR PACKAGING is provided.

A chain of interconnected pre-opened bags is fed from the supply 21 along a path indicated schematically at 22 to feed rolls 23. Bags are fed downwardly sequentially and one at a time from the feed rolls 23 to a load station 24.

An indicia detector is shown schematically at 25. The indicia detector is of the type described in U.S. Pat. No. 4,392,056 entitled CONTROL MARKING DETECTOR. The bags are equipped with invisible indicia of the type described in U.S. Pat. No. 4,467,207 entitled NONMIGRATING CONTROL INDICIA FOR A PLASTIC WEB OR SHEET ARTICLE and U.S. Pat. No. 4,680,205 entitled CONTINUOUS WEB REGISTRATION. The indicia and detector function to send a signal to a control 26. The control in response to the receipt of a signal indicating a bag is appropriately positioned at the load station stops the operation of the feed rolls 23.

A blower 27 is provided. The blower selectively supplies a supply of air through a tube 28. Air supplied through the tube 28 blows a bag positioned at the load station 24 open as a first step in the loading operation.

Figure 2:
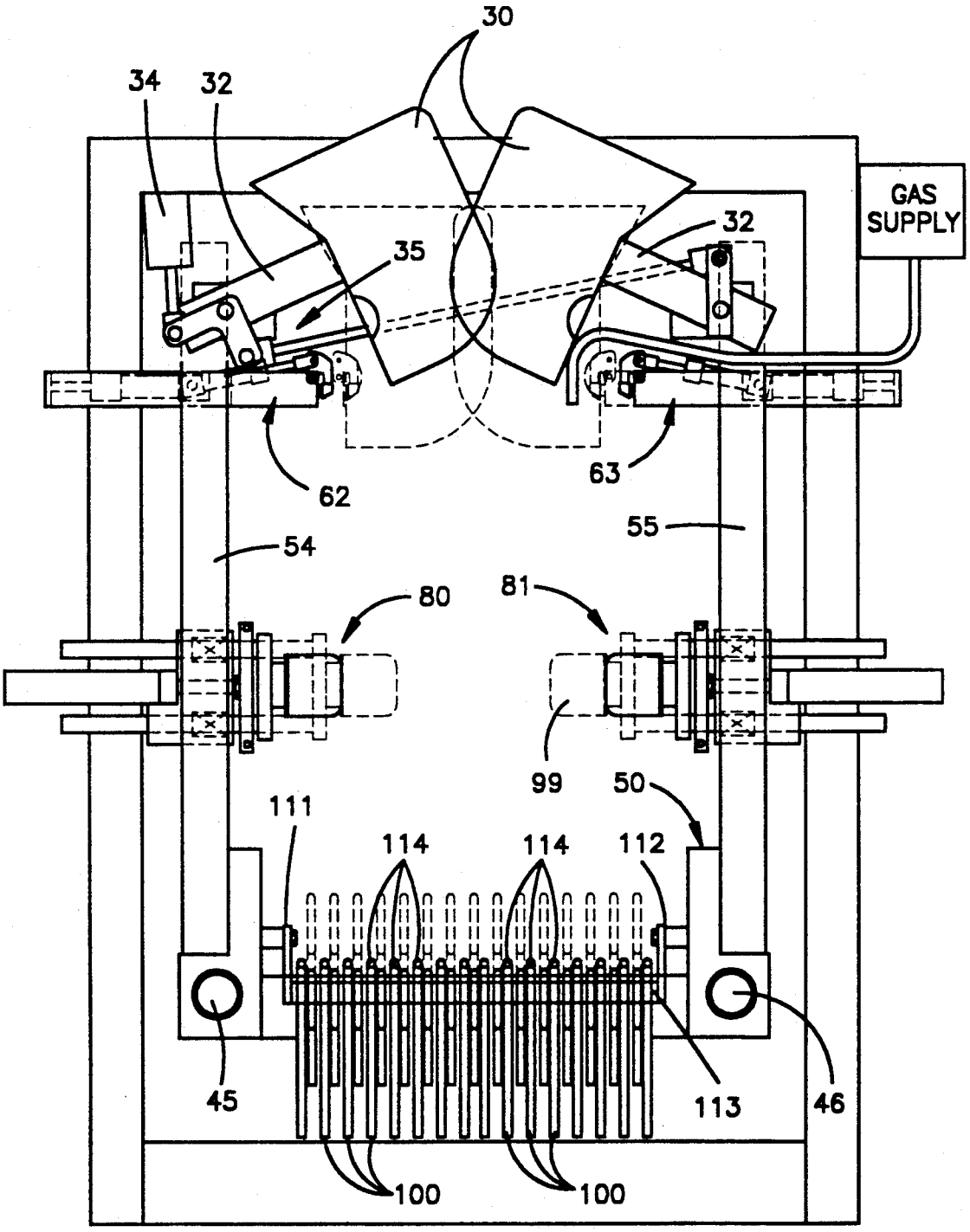
FIG. 2 is a fragmentary front elevational view of the bag manipulating mechanisms at the load station.
Figure 9A:
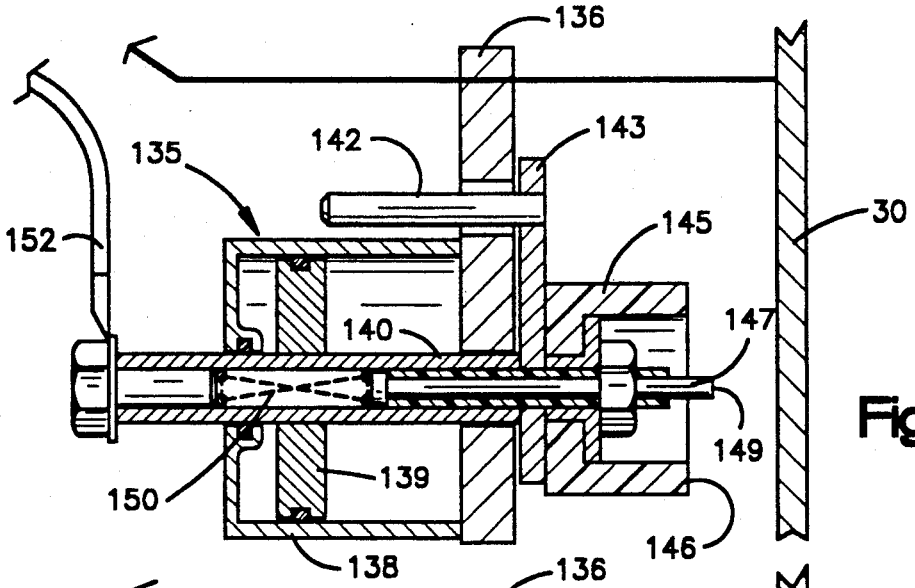
FIGS. 9A–9C are sequential drawings showing the operation of a bag gripper and sensor mechanism.

A pair of horns 30 are provided, FIG. 2. The horns are respectively carried by pivotal arms 32. A horn actuating cylinder 34 is connected to the arms 32 by a linkage shown at 35. The horns are movable from a retracted position shown in solid lines in FIG. 2 to a bag expansion position indicated in phantom in FIG. 2. The movement of the horns from the retracted to the bag expansion position is accomplished after a bag to be loaded has been positioned in the load station and inflated by air supplied through the air tube 28. Once in the bag expansion position the horn expands the top of the bag to the position best seen in FIG. 9.

A material supply hopper 36 is positioned above the load station 24. The hopper includes a swingable gate 37 for selectively discharging products to be packaged.

The Bag Transfer Mechanism

Figure 4:
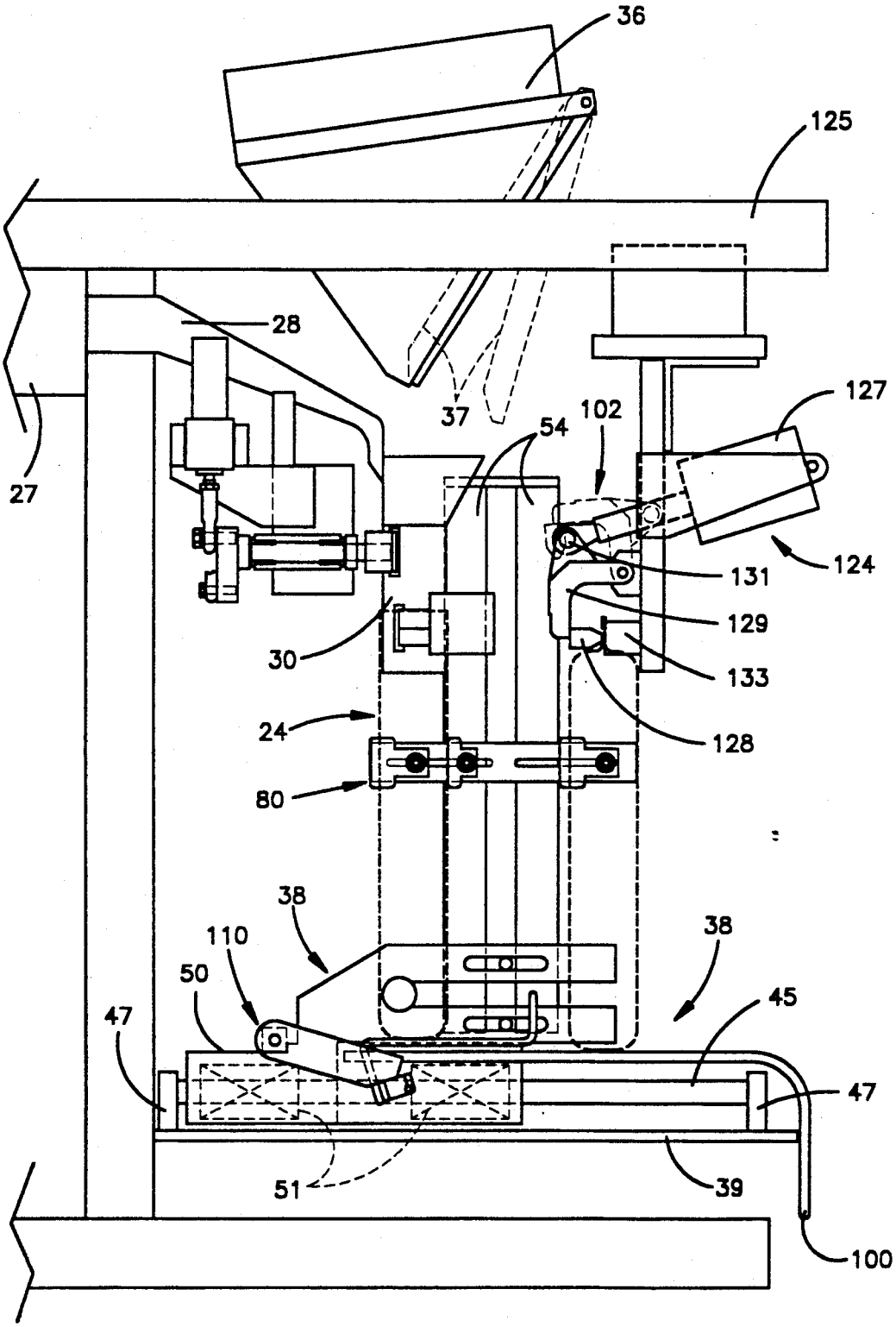
FIG. 4 is a somewhat schematic side elevational view of a bag shuttle assembly and associated mechanisms used to effect loading and sealing with the carriage in its load position to support a bag at the load station.
Figure 5:
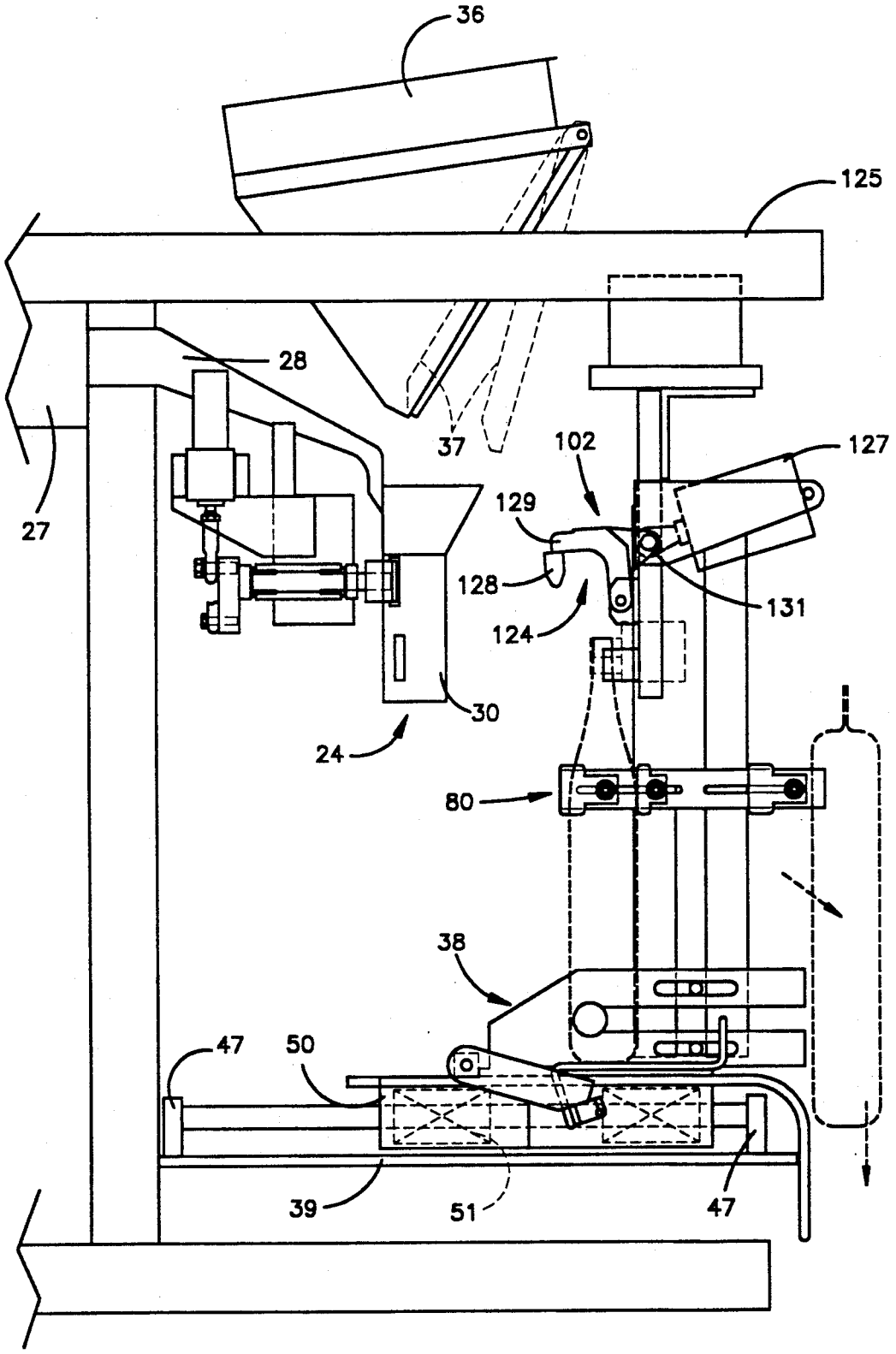
FIG. 5 is a view similar to FIG. 4 but showing the carriage in its bag transfer position transferring a loaded bag to the closure station.

A bag transfer mechanism is shown generally at 38, FIGS. 1, 4, and 5. The transfer mechanism includes a vertically adjustable support platform 39. The support platform 39 is mounted on a pair of vertically disposed screws, one of which is shown at 40. An adjustment crank 42 is coupled to a cross shaft 43, FIG. 1. The cross shaft 43 is connected by bevel gears (not shown) to the vertical screws 40. Thus, rotation of the crank 42 will cause rotation of the vertical screws 40 which in turn will cause elevation or depression of the support platform 39.

A pair of carriage guides in the form of cylindrical rods 45, 46 are provided. The carriage guides are supported above the platform 39 by guide supports 47, FIGS. 4 and 5.

A carriage 50 is reciprocally mounted on the guide rods 45, 46. Linear bushings 51, 52 journal the carriage on the guide rods for reciprocal motion between a bag loading position shown in FIG. 4 and a bag transfer position shown in FIG. 5. A pair of twin post, vertical supports 54, 55 the vertical support 54 is adjustably secured to the carriage 50. The securing of the vertical support 54 is by fasteners 56 which project through elongated slots 57, 58 in carriage tines 59, 60, FIG. 6. The vertical support 55 is coupled through a mirror image structure shown in plan view in FIG. 8.

A pair of bag spreader assemblies 62, 63 are best seen in FIG. 2. The spreader assemblies are mirror images of one another. Their construction, operation, and function are best understood by reference to FIGS. 3A–C where the spreader 62 is shown in enlarged and sequential form.

The bag spreader assembly 62 is adjustably secured to the vertical support 54 by a clamp 55. The clamp 55 allows vertical adjustment movement to adjust the spreader assembly 62 whenever the height of the platform 39 is adjusted. The spreader assembly includes a finger 67 which is pivotally connected at 68 to a reciprocatable element 69. A finger actuation air cylinder 71 is provided. The finger actuation cylinder 71 is pivotally connected at 72 to a finger extension cylinder 73. Energization of the extension cylinder 73 causes the finger 67, the reciprocatable element 69, and the finger actuation cylinder 71 to move from the position shown in FIG. 3A in solid lines to the phantom line position of FIG. 3A and in the case of the reciprocatable element the solid line position of FIG. 3B.

Figure 3A:
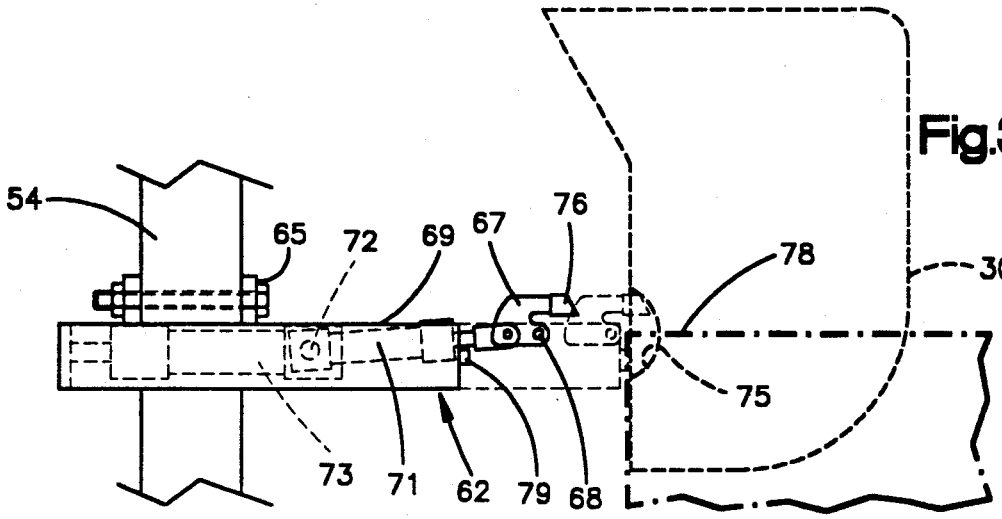
FIGS. 3A–C are somewhat diagrammatic, sequential views showing the action of bag gripping fingers.
Figure 3B:
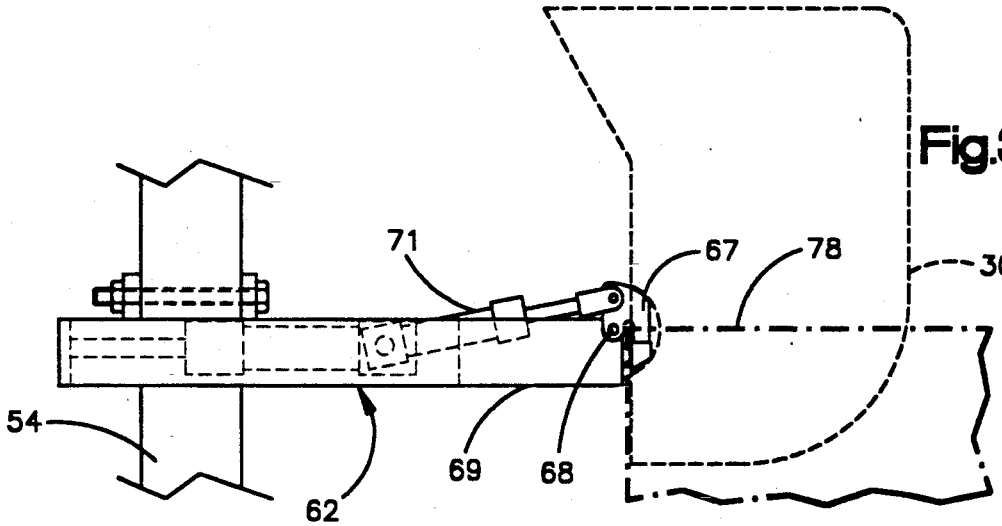

Once the finger 67 is in the phantom line position of FIG. 3A it has projected into a horn recess 75. As a next step in the bagging operation, the finger cylinder 71 is actuated to extend it causing the finger to pivot about its pivot support 68 to the position shown in FIG. 3B wherein a bag is gripped between finger tip 76 and a pad 79 carried on the reciprocatable element 69. The finger tip and the pad elements are respectively made of materials adapted to frictionally engage the bag.

Figure 3C:
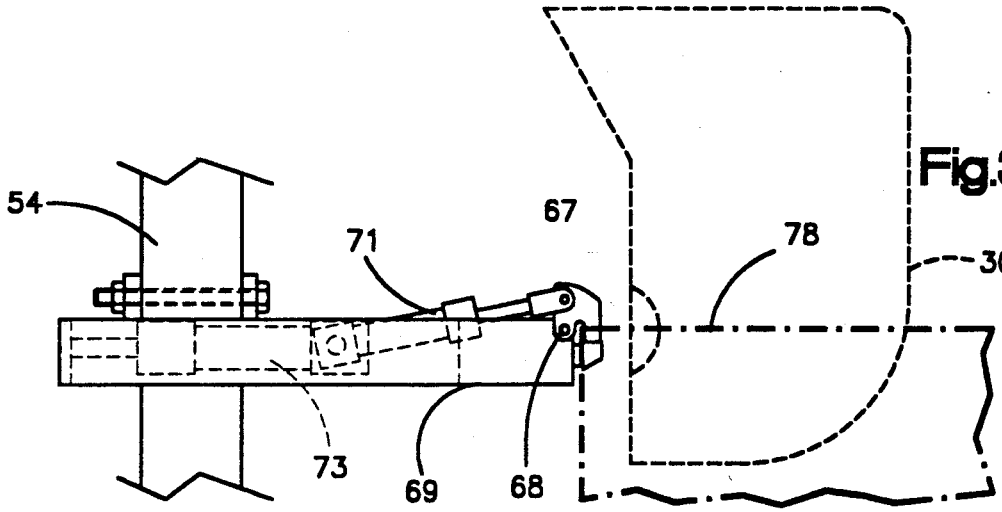

Once a bag has been loaded the extension cylinder 73 is retracted and the horn is pivoted to the position shown in FIG. 3C. The equal and opposite movement of the bag spreaders 62, 63 with the bags gripped by the fingers, tensions the bag pulling top portions of the front and back of the now loaded bag into juxtaposition.

Figure 11:
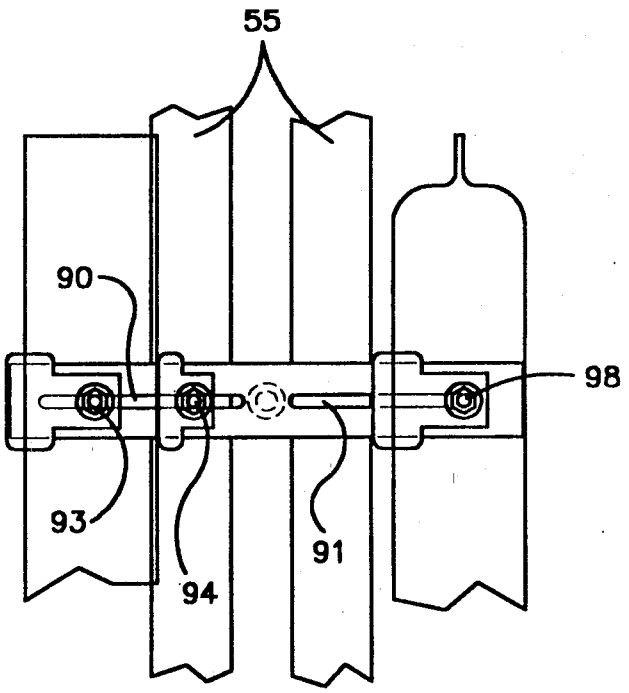
Figure 10:
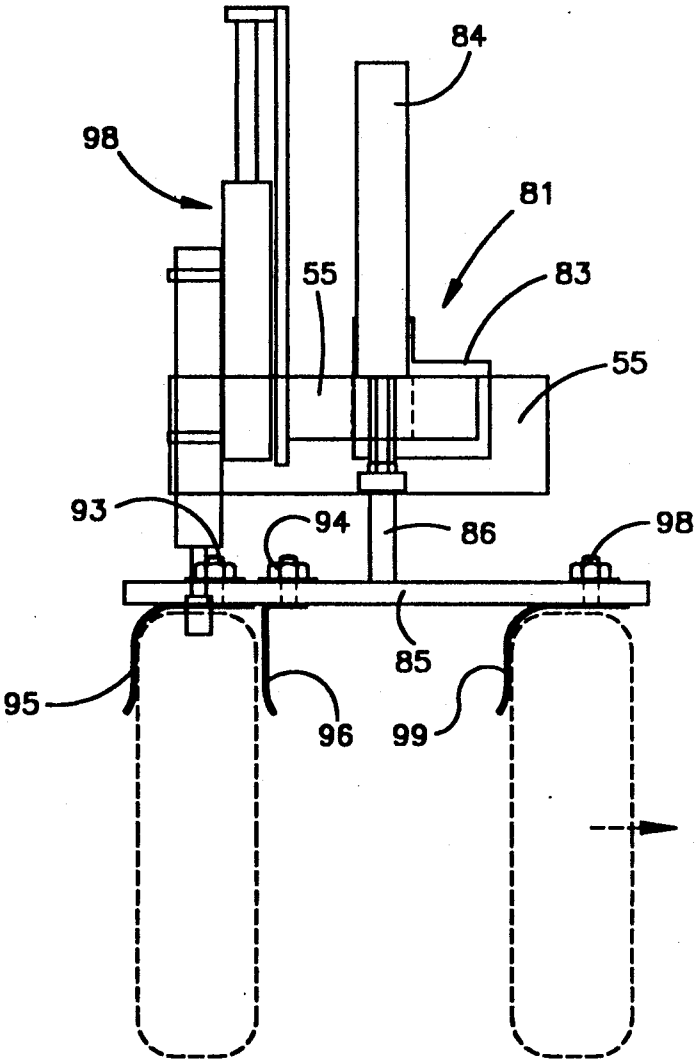
FIG. 10 is a top plan view of the intermediate bag support assembly on an enlarged scale; and, FIG. 11 is a fragmentary elevational view of the intermediate bag support assembly of FIG. 10.

A pair of intermediate support assemblies 80, 81 are provided. The intermediate support assembly 81 is shown in some detail in FIGS. 10 and 11 and reference to those figures will enable a better understanding of it. It should be recognized that the intermediate support 80 is a mirror image of the support 81.

The support 81 includes a clamp 83. The clamp 83 secures the intermediate support 81 to the vertical support 55 at a vertically adjusted and selected position. An air cylinder 84 is connected to the clamp 83. An intermediate support air cylinder 84 projects between the posts of the vertical support 55.

A horizontally disposed support plate 85 is connected to a rod 86 of the support cylinder 84. A telescopic guide mechanism 88 is connected to the clamp 83 and to the support plate 85 to maintain the support plate in a horizontal orientation.

The support plate 85 includes a spaced pair of longitudinally disposed slots 90, 91. The slot 90 receives fasteners 93, 94 which respectively secure bag support elements 95, 96 to the support plate 85. The bag support elements 95, 96 together provide a U shaped support for a bag positioned at the load station. The slot 91 receives a fastener 98. An L shaped closed bag support 99 is secured to the support plate 85 by the fastener 98.

The support plate 85 and the bag supports it carries are reciprocal between the retracted position shown in solid lines in FIG. 2 and the inward bag support position shown in phantom lines in the same figure.

Figure 8:
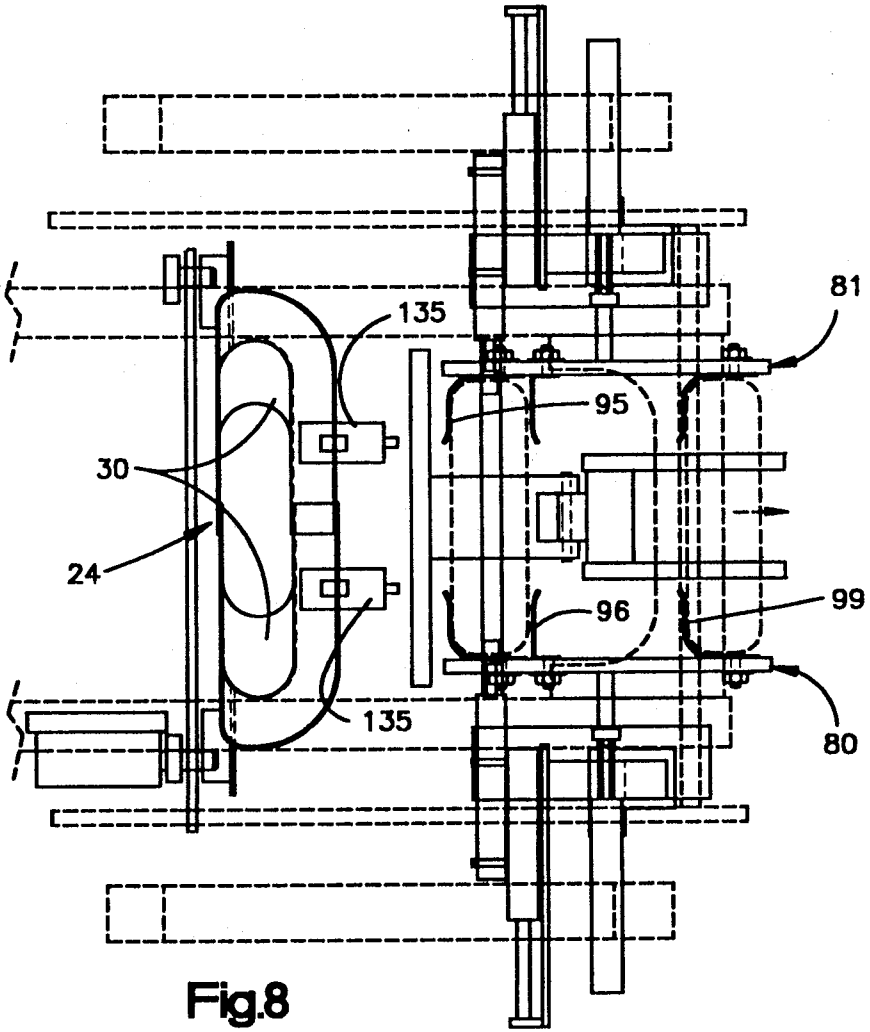
FIGS. 7 and 8 are fragmentary top plan views of the transfer carriage and associated mechanism with the carriage in the load position in FIG. 7 and the transfer position in FIG. 8.

Referring to FIGS. 2 and 8, a bag support in the form of a series of inverted L shaped rods 100 are provided. The rods are secured to the platform 39 and function to support the bottoms of bags positioned respectively at the load station 24 and a bag fastening or closure station 102.

Figure 6:
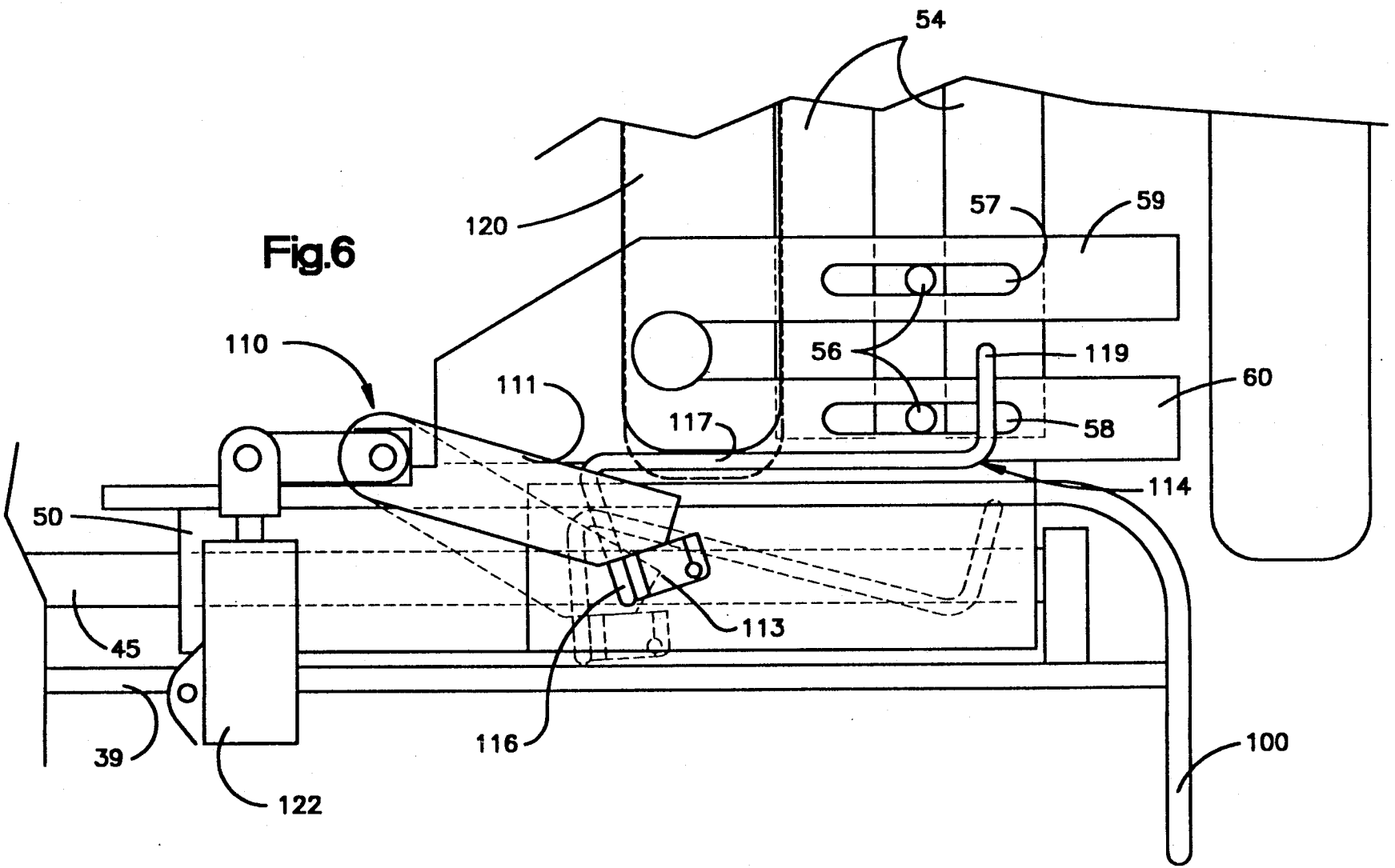
FIG. 6 is an enlarged fragmentary view showing a moveable base structure in solid lines in its transfer position and in phantom lines in the position assumed during a bag loading operation and associated elements of the carriage and the bottom support.

A bag transfer support assembly 110 is provided and best understood by reference to FIGS. 2 and 6. The transfer assembly 100 includes a pair of pivotally mounted end links 111, 112. A cross bar 113 is secured to and interconnects the links 111, 112. A plurality of shaped Z shaped supports 114 are provided. Each Z shaped support is positioned between an adjacent pair of support rods 100, FIG. 2. Each Z shaped support includes a support arm 116 fixed to the cross bar 113. Each Z shaped support also includes stem 117 and an upstanding arm 119.

The transfer support assembly has a storage position shown in solid lines in FIG. 2 and in phantom in FIG. 6. The transfer support assembly is movable from the phantom line position of FIG. 6 to the solid line position of FIG. 6. In the solid line position of FIG. 6 the stems 117 have moved from their storage position to a bag support position paralleling and above the base support rods 100. Thus, a bag 120 has been moved from its load position resting against the base support rods to a transfer position as depicted in FIG. 6.

When the transfer support assembly is in this transfer position the upstanding arms 119 project vertically as is depicted in FIGS. 4 and 6. The movement of the transfer assembly between its storage and transfer positions is occasioned by the operation of a transfer assembly cylinder 122, FIG. 6.

The Bag Closure Station 102

A sealing assembly is shown generally at 124. The sealing assembly depends from a frame element 125. When a bag has been loaded at the load station 24, had its top portion stretched closed by the finger action described in connections 3A–C and been transferred from the load station to the seal station as depicted by FIGS. 4 and 5, it is prepared for a closing operation.

In the disclosed and preferred arrangement, the closure is effected by the sealing assembly 124. The sealing assembly includes a seal actuation cylinder 127. A seal bar 128 is carried by a seal bar link 129. The seal bar link 129 is pivotally connected at 131 to the rod of the cylinder 127. When the cylinder is actuated the link 129 is pivoted from the position of FIG. 5 which is the phantom line position of FIG. 4 to the solid line position of FIG. 4. In the latter position the top of the loaded bag is clamped between the seal bar 128 and a seal pad 133 and the loaded bag is sealed to complete a package.

The Bag Clamp and Sensor

Figure 7:
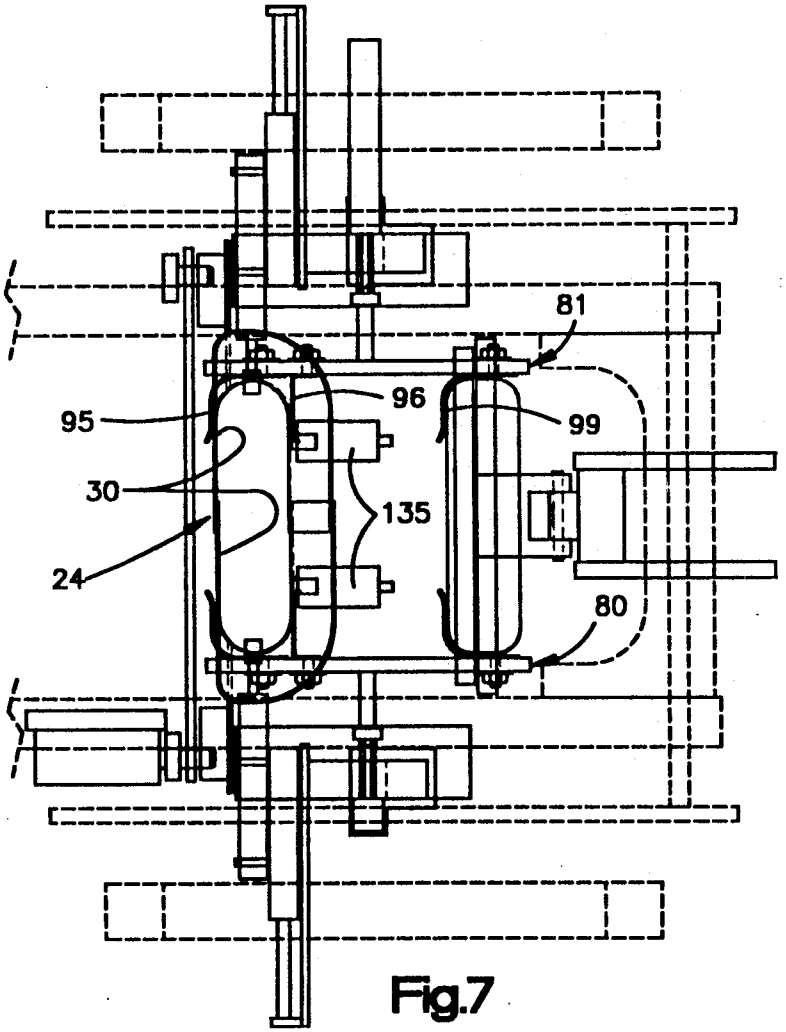

A pair of bag clamp and sensor assemblies 135 are provided, FIGS. 7–9. The clamp and sensor assemblies 135 are carried by a support plate 136 which is connected to the frame 125. Each assembly 135 includes an air cylinder 138 having a piston 139. An elongated tubular piston rod 140 is connected to the piston 139 and projects from both ends of the cylinder and through the support plate 136.

A pin 142 is carried by a rotation inhibiting plate 143. The plate 143 is fixed to the piston rod 140 on the side of the support plate 136 opposite the cylinder 138. The pin 142 extends through an aperture in the support plate 136 to inhibit unwanted rotation of the piston rod 140.

An annular clamp cup is secured to the piston rod and abuts against the rotation inhibiting plate 143. The cup 145 is of suitable friction material such that its end surface 146 will frictionally engage and retain a bag 120 when positioned a depicted in FIG. 9B.

Figure 9B:
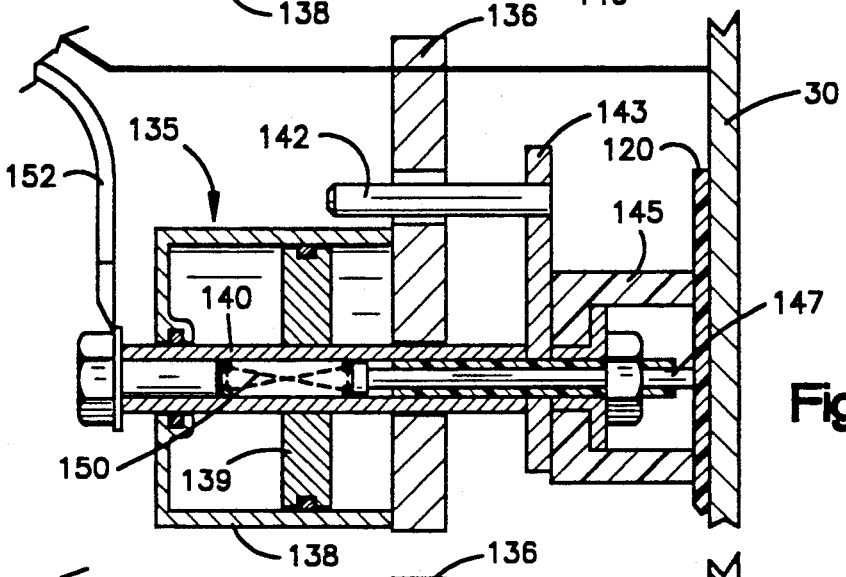
Figure 9C:
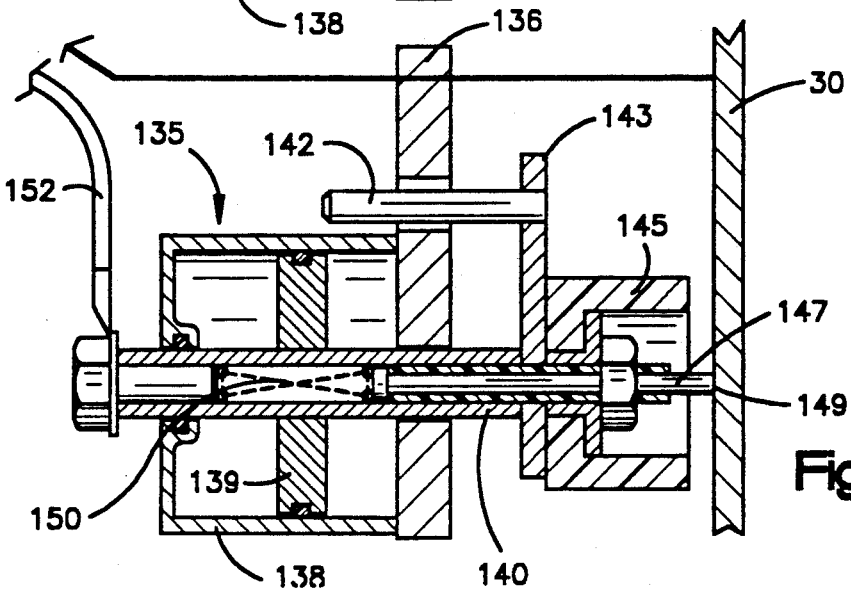

A contact pin 147 is provided. The contact pin is coaxially positioned within the tubular rod 140. The contact pin 147 has an end contact surface 149 adapted to engage a bag 120 in electrically insulated relationship with the horn 30 as depicted in 9B or alternatively if a bag is absent from the horn to contact the horn in electrically conductive relationship as depicted in FIG. 9C.

A spring 150 is within the piston 140 and in biasing relationship with the contact pin 147. Thus, in the position of FIG. 9A the pin is biased to a position where its end surface 149 is on the horn side of a plane located by the cup surface 146, is in the plane of that surface when a bag 120 is positioned and clamped as depicted in FIG. 9B and projects from that surface to engage the horn 30 as depicted in 9C if a bag is missing. When the contact pin 147 engages the horn 30 as depicted in FIG. 9C a circuit is completed and a signal is transmitted to the control 26 by a conductor 152.

Operation

A bag supply 21 is provided and the bags are fed from the supply 21 along the path 22 to the feed rolls 23. On an appropriate start signal from the controller 26 the feed rolls are operated to feed the end one of the chain of bags into the load station. As soon as the detector 25 senses the indicia on the bag being positioned feed stops.

As feed is stopped the positioned bag is blown open and the horns 30 are moved from the solid line position of FIG. 2 to the phantom line position to expand and grip the bag. The bag clamp and sensor cylinders 138 of the sensor assemblies 135 are then actuated to move the clamp cups 145 into engagement with the bag.

If no bag is present, or if it is improperly positioned, either or both of the contact pins 147 will engage the associated horn 30, as depicted in FIG. 9C, completing a circuit. A signal is then sent via the conductor 152 to the control 26 which will disable all operations other than causing the feed rolls to attempt to feed another bag. The machine will make two attempts in addition to the original faulty attempt and if no bag is properly positioned after the three attempts, the control will then shut the machine down.

Assuming a bag has been appropriately fed, the pin and the cup engage the bag 120 as depicted in FIG. 9B and the machine continues to cycle. Feed rolls 23 reverse to retract the chain of bags somewhat and to sever the bag positioned at the load station 24 from the chain of pre-opened bags.

At about the same time the finger extension cylinder 73 and the intermediate support cylinder 84 are energized. This moves the intermediate support from the position shown in solid lines in FIG. 2 to the position shown in phantom in FIG. 2 and the position shown in solid lines in FIG. 10 to support the positioned to be loaded bag. Concurrently with the positioning of the intermediate support, the finger 67 is moved from the solid line position of FIG. 3A to the phantom position of FIG. 3A. At this juncture the finger cylinder 71 is actuated to move the finger into its position of FIG. 3B clamping the bag.

The discharge gate 37 is opened and products are dispensed from the hopper 36, through the funnels 30 into the bag at the load station. Next the transfer assembly cylinder is actuated to elevate the Z shaped supports into their bag support and transfer position as shown in FIG. 6. Concurrently the horns are withdrawn and the extension cylinders 73 are retracted to tension the bag and pull top portions of the face and back of the bag into juxtaposed relationship. This also functions to dispel air or other gas from the bag.

Next a carriage transfer cylinder 154 is energized to shift the carriage and its supported transfer mechanism from its load position of FIG. 4 to its bag transferred position of FIG. 5. The seal cylinder 127 is now actuated to close the seal bar 128 and commence a sealing of the loaded bag which has been transferred to the bag closure station 102.

As soon as the seal bar has closed the fingers 67 are withdrawn from the bag being sealed and the extension cylinders 73 and the intermediate support cylinders 84 are reversed to withdraw the supports and the fingers. At this juncture the carriage is returned to the load station. Concurrent with the carriage transfer of a loaded bag to the closure station, a succeeding bag is fed to the load station and grasped by the horns.

In the second and subsequent cycles there will be a loaded bag at the closure station. As soon as a seal has been timed out, the seal cylinder 127 will reverse to open the sealer. As the next loaded bag commences its transfer from the load to the closure station, a completed bag will have been released from the sealer and movement of the carriage will cause the L shaped bag supports 99 to push the completed package from the closure station. If the loaded package does not fall freely from the machine, the upstanding arms 119 of the Z shaped supports 114 will push it from the base support rods 100 as the carriage advances with the next loaded bag.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

We claim:

1. In a bagging machine a bag spreading assembly comprising:

a) a spaced pair of horns movably mounted for opposed motion, each horn including a lower bag engaging porion;

b) horn manipulation means for moving the horns from bag disengaged positions to bag mouth engagement and spreading positions;

c) a pair of bag spreader subassemblies each including a moveable bag engaging finger;

d) each of the horns including a finger receiving recess in its bag engaging portion; and, e) each spreader subassembly including a finger manipulation means connected to the finger of the same assembly for:

i) moving the connected finger from a rest position into an associated one of the horn recesses when the horns are in their bag spreading positions;

ii) spreading the fingers once in the recesses to engage a bag as it is engaged by the horns;

iii) further spreading the fingers to substantially close an engaged bag as the horns are moved from their bag spreading positions to the disengagement positions; and, iv) continuing to engage the bag until a bag fastener has at least commenced to fasten the bag in a closed condition.

2. The machine of claim 1 wherein the bag spreader subassemblies each include a reciprocally mounted pivot pivotally supporting the finger of that subassembly for pivotal movement between bag engaged and bag disengaged positions.

3. The machine of claim 1 wherein the spreader subassemblies each include a cylinder actuated linkage connected to the finger of that subassembly.

4. The machine of claim 1 wherein each of the spreader subassemblies is mounted on a carriage for transport of a loaded bag from a loading to a bag fastening station as the bag is spread by the fingers.

5. The machine of claim 1 wherein the bag fastener is a heat sealer.

6. In a bagging machine having a bag supply for supplying bags to a bag loading station and a bag transfer mechanism independent of the bag supply for transferring a loaded bag to a bag closure station comprising:

a) a carriage;

b) a carriage guide and support structure, the carriage being mounted on the structure for reciprocal movement between the stations;

c) a bag stretching and holding means mounted on the carriage for stretching and holding a loaded bag as the carriage moves to transfer a loaded bag from the loading station to the closure securing station;

d) a bag bottom support mounted over at least a portion of the carriage for supporting a loaded bag as the carriage moves from the loading to station to the closure securing station; and, e) an adjustment operably interposed between the stretching and holding means and the bottom support for relative adjusting ;movement of the means and the bottom support to adjust the spacing between the two according to the size of bag to be loaded.

7. The transfer mechanism of claim 6 wherein the stretching and holding means includes a pair of reciprocally and pivotally mounted fingers.

8. The transfer mechanism of claim 6 wherein a spaced pair of intermediate bag supports are provided intermediate the stretching and holding means and the bottom support.

9. The transfer mechanism of claim 8 wherein the intermediate bag supports are reciprocally mounted on the carriage for movement toward and away from a bag carried by the stretching and holding means.

10. In a machine for packaging products in bags supplied in the form of preopened interconnected bags, an improved mechanism for transferring loaded bags from a bag loading station to a station for fastening loaded bags in closed condition comprising:

a) a spaced pair of horizontal rails;

b) a carriage reciprocatably mounted on the rails for reciprocal movement along a path between the stations;

c) a bag stretching and holding assembly carried by the carriage and including a spaced pair of prime movers for providing opposed reciprocal motion and a spaced pair of bag engaging fingers respectively mounted on the prime movers for opposed reciprocation toward and away from one another for grasping top portions of bags at the load station and stretching each such bag, once loaded, to close such bag for transfer and fastening;

d) a bag transfer support of generally Z shaped cross section pivotally connected to the carriage near the head of the Z;

e) an apertured bottom bag support mounted over at least a portion of the carriage;

f) a base prime mover for shifting the transfer support from a storage position below the bottom support to an elevated position with the arm of the Z projecting through a bottom support aperture; and, g) the transfer support being adapted when in the elevated position to push a loaded and fastened bag from the fastening station as the carriage transfers another loaded bag from the loading station to the fastening station.

11. The mechanism of claim 10 wherein the reciprocal motion of the fingers is orthogonal to the reciprocal motion of the carriage.

12. The transfer mechanism of claim 10 wherein a spaced pair of intermediate bag supports are provided intermediate the stretching and holding assembly and the bottom support.

13. The transfer mechanism of claim 12 wherein the intermediate bag supports are reciprocally mounted on the carriage for movement toward and away from a bag carried by the stretching and holding assembly.

14. The mechanism of claim 10 wherein the prime movers are air cylinders.

* * * * *